United States Patent [19]

Gheorghe et al.

[11] 4,069,621

[45] Jan. 24, 1978

[54] APPARATUS FOR MACHINING BEARING ROLLS

[75] Inventors: Dumitru Gheorghe, Brasov; Mihail Renghes, Ploiesti; Gheorghe Serban, Ploiesti; Vasile David, Ploiesti, all of Romania

[73] Assignee: Intreprinderea "Mecanica" Plopeni, Plopeni, Romania

[21] Appl. No.: 697,226

[22] Filed: June 17, 1976

[51] Int. Cl.[2] ..... B24B 11/06

[52] U.S. Cl. ..... 51/117; 51/130

[58] Field of Search ..... 51/111 R, 116, 117, 51/118, 130, 165.9, 34 J, 289 S

[56] References Cited

U.S. PATENT DOCUMENTS

| | | | |
|---|---|---|---|
| 1,177,699 | 4/1916 | Hanus | 51/130 |
| 2,045,488 | 6/1936 | Oubridge | 51/118 |
| 2,085,005 | 6/1937 | Cole | 51/118 |
| 2,906,066 | 9/1959 | Laverdisse | 51/165.9 |
| 2,926,464 | 3/1960 | Surerus | 51/117 |
| 3,035,377 | 5/1962 | Bouensiepen | 51/111 R |
| 3,791,083 | 2/1974 | Messerschmidt | 51/130 X |

*Primary Examiner*—Harold D. Whitehead
*Assistant Examiner*—Nicholas P. Godici
*Attorney, Agent, or Firm*—Karl F. Ross

[57] ABSTRACT

An apparatus for machining bearing balls has a motor which drives, through an elastic coupling, a gear box connected by a telescoping coupling to a crown gear device. The output of the crown-gearing is applied to a rotatable disk. An electric motor drives a gear pump which has its output connected by an electromagnetic distributor to a hydraulic cylinder adapted to press the rotatable disk against a fixed disk, the balls being circulated between the disk and machine (filed, ground or lapped) therebetween.

2 Claims, 3 Drawing Figures

APPARATUS FOR MACHINING BEARING ROLLS

FIELD OF THE INVENTION

The present invention relates to an apparatus for machining bearing balls and, more particularly, to a machine for the filing, grinding or lapping of the balls of a ball bearing.

BACKGROUND OF THE INVENTION

An apparatus for machining ball bearing balls is known in which the balls are machined between a rotatable surface and a fixed surface. The disadvantage of this prior art machine is that there are relatively large, afford only a narrow range of technological machining parameters, is unstable because of the fixed parameters, do not afford a uniform circulation of the balls to be machined, and have a high level of operating noise.

OBJECT OF THE INVENTION

It is the object of the present invention to provide an apparatus for the machining of bearing balls which avoids the aforementioned drawbacks, is of compact design utilizing a minimum amount of material, has high productivity and a low level of operating noise.

SUMMARY OF THE INVENTION

This object and others which will become apparent hereinafter are attained, in accordance with the present invention, in an apparatus for machining bearing balls having a rotatable machining disk and a fixed machining disk, the balls being machined between these disks. An electric motor drives, by means of an elastic coupling, a gear box which, in turn, operates a telescoping-shaft transmission, the output of which is applied through a helicoidal gearing system with a high speed reduction ratio, to the rotatable disk. To apply the machining force to the mobile disk, the latter is axially shiftable on a piston displaceable in a cylinder by a hydraulic system which comprises an electric motor, a gear pump driven by the electric motor, an electromagnetic distributor valve, and a controllable throttle with a direction or one-way valve. An electrohydraulic pressure relay is also provided for the hydraulic system which includes a hydraulic accummulator. A rotary supply device feeds the balls uniformly between the disks and is controlled by a variable-speed transmission having a large control range.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
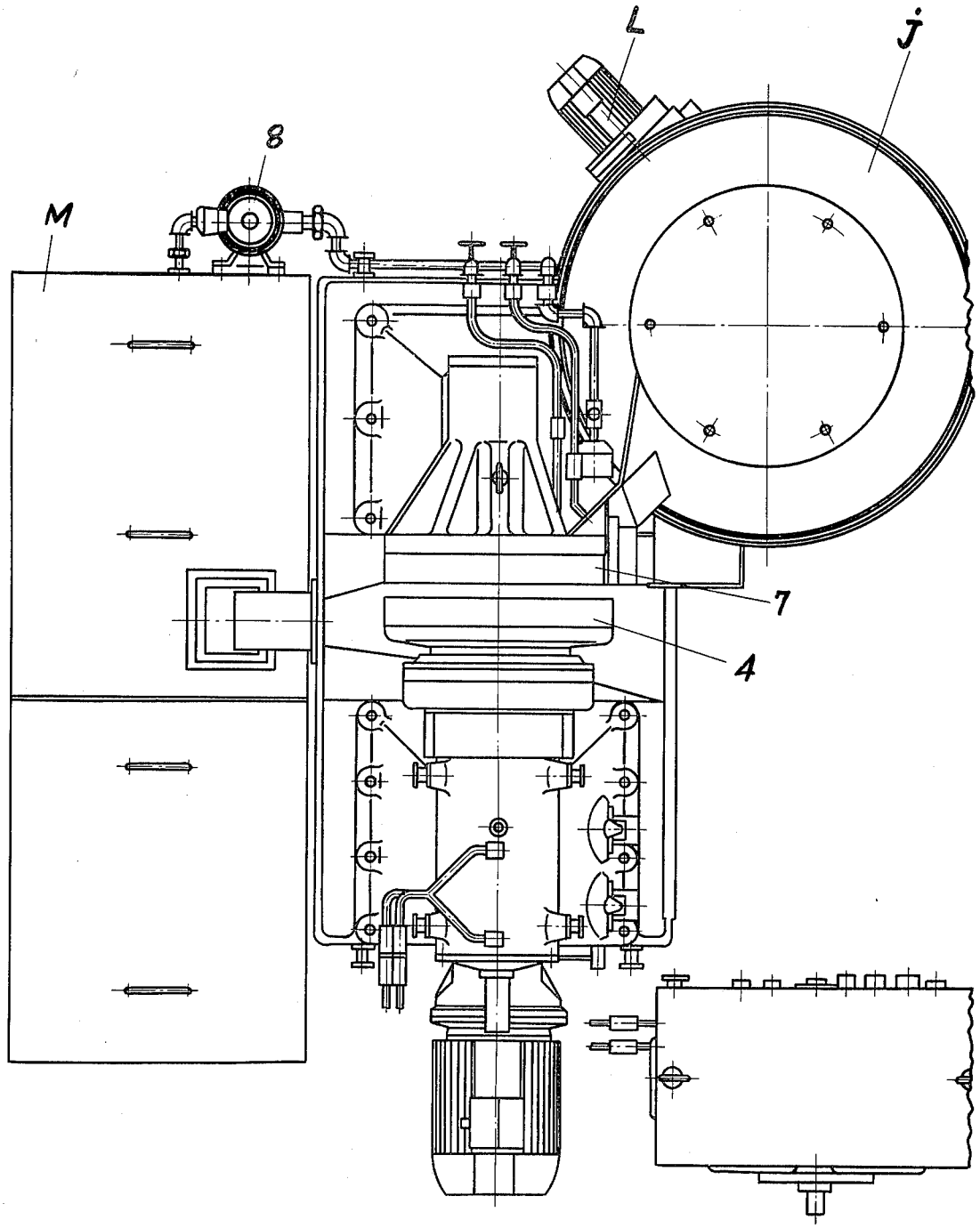
FIG. 1 is a plan view of the machine according to the invention.
Figure 2:
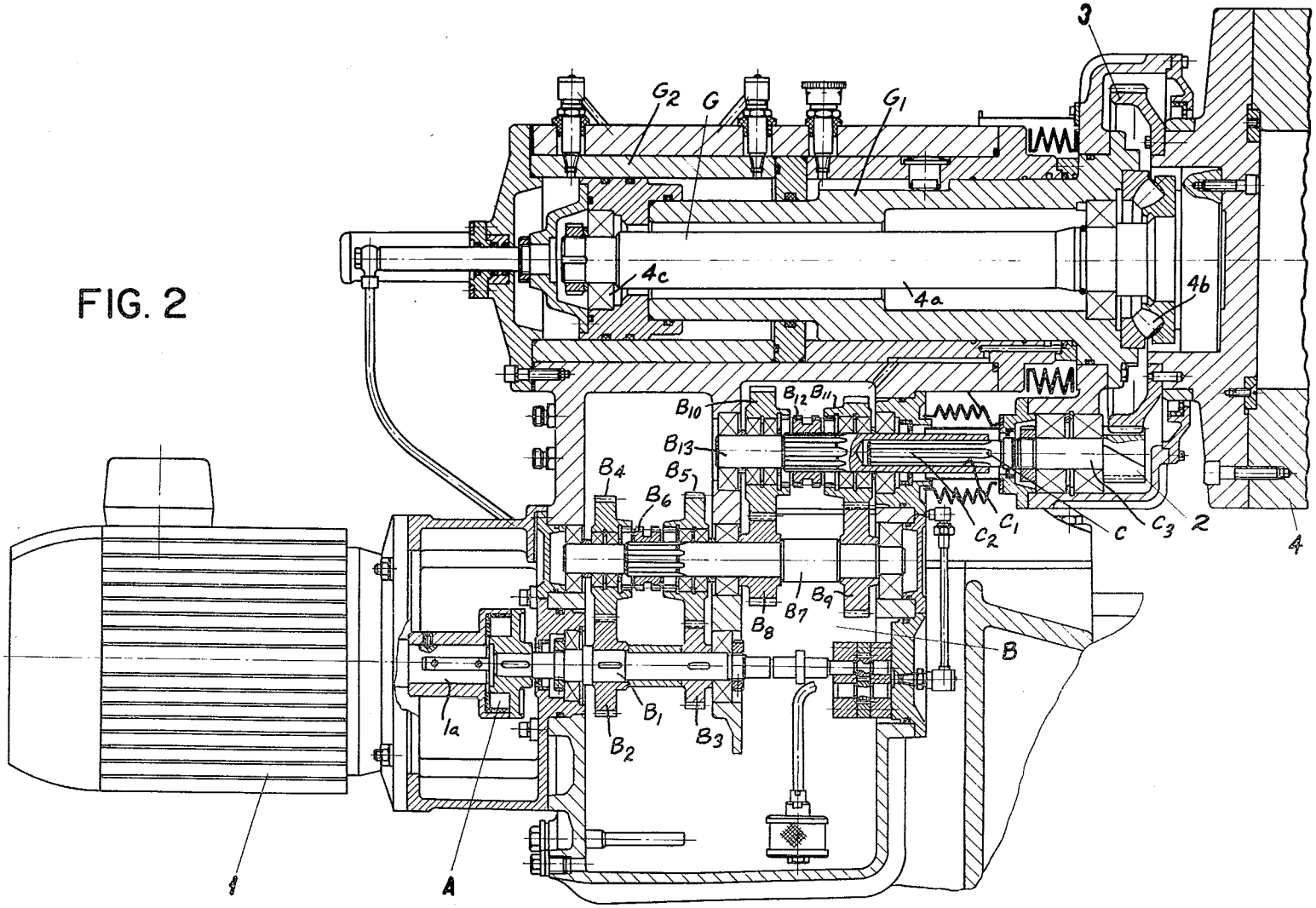
FIG. 2 is a longitudinal section along a vertical plane through the drive system of the machine of FIG. 1.

The machine illustrated in FIGS. 1 and 2 comprises an electric motor 1 whose shaft 1*a* is connected by an elastic coupling A to the input shaft $B_1$ of a gearbox B.

As will be especially apparent from FIG. 2, the shaft $B_1$ of the gearbox is keyed to a pair of gears $B_2$ and $B_3$ respectively meshing with gears $B_4$ and $B_5$ freely rotatable upon a shaft $B_7$ provided with splines along which a clutch $B_6$ can be shifted to engage either gear $B_4$ or gear $B_5$ and hence drive the shaft $B_7$ with a speed-reducing gearing established by the ratios of the gear pairs $B_2$, $B_4$ and $B_3$, $B_5$, respectively. The gearbox B also includes a pair of gears $B_8$ and $B_9$ carried by the shaft $B_7$ and respectively meshing with gears $B_{10}$ and $B_{11}$ freely rotatable on an output shaft $B_{13}$ whose splined portion carries a clutch $B_{12}$ selectively engageable with gear $B_{10}$ or gear $B_{11}$.

The output shaft $B_{13}$ is connected to a grooved telescopic coupling C which can include (see also FIG. 2) an internally splined socket $C_i$ on the shaft $B_{13}$ and receiving the splined end $C_2$ of a shaft $C_3$ carrying a pinion 2 meshing with a crown gear 3 connected to the rotatable disk 4 which has been stippled to indicate that it is composed of abrasive material.

Figure 3:
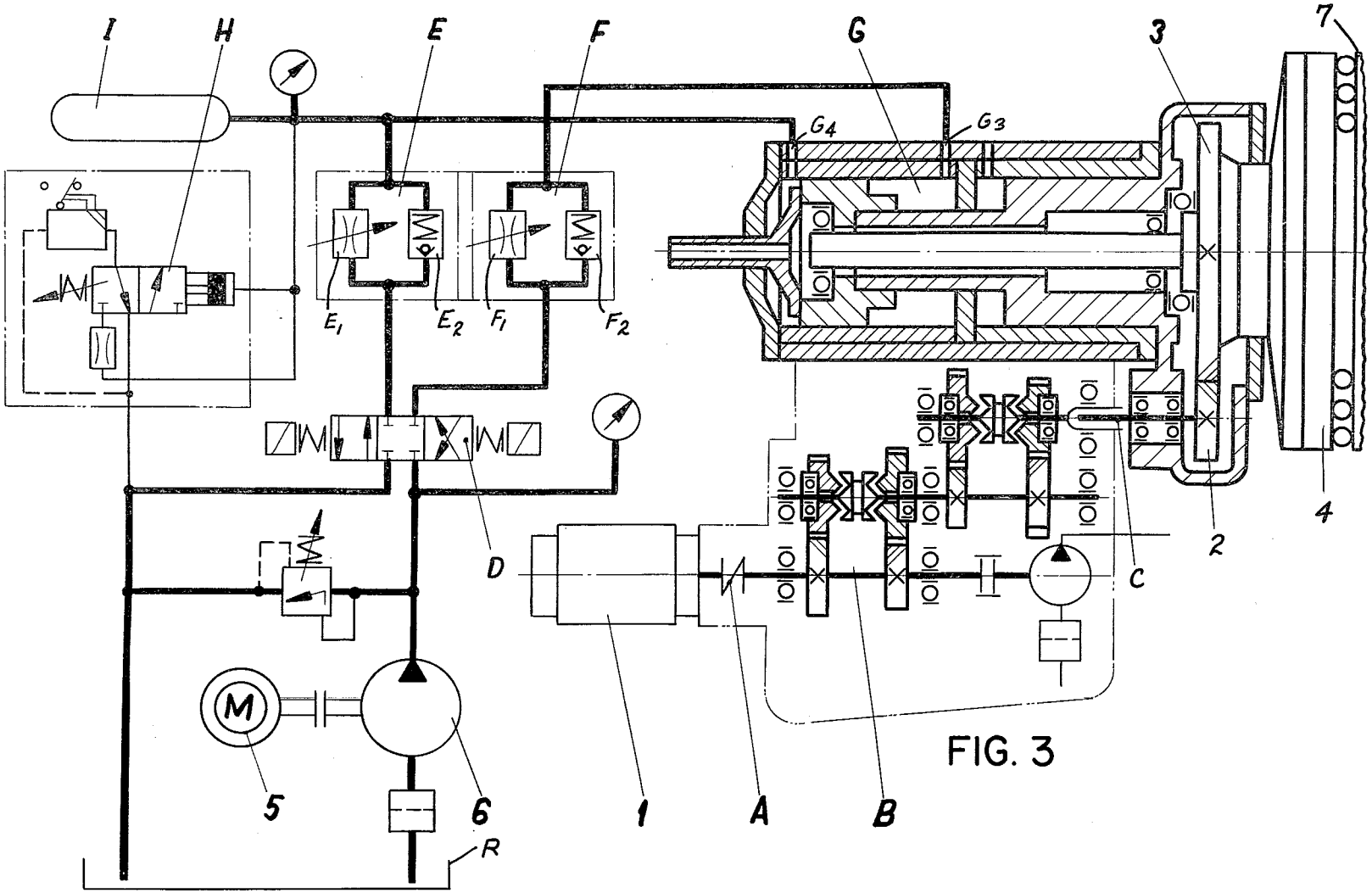
FIG. 3 is a hydraulic circuit diagram of the machine.

The disk 4 is mounted upon a piston $G_1$ displaceable in a cylinder $G_2$ of a hydraulic motor G which applies the thrust force to the rotatable disk 4 and hence creates the cutting force upon the balls interposed between the disk 4 and the fixed disk 7 (see FIGS. 1 and 3). The rotatable disk 4, in turn, is attached to a shaft 4*a* journaled by bearings 4*b* and 4*c* in the piston $G_1$, so that the disk 4 is free to rotate relative to this piston. A thurst bearing is formed by the bearing 4*b*.

Referring again to FIGS. 1 and 3, it can be seen that a motor 5 drives a gear pump 6 which draws hydraulic fluid from a reservoir R and feeds it to an electromagnetic distributor D. The output ports of this distributor are each connected through a controllable throttle $E_1$ or $F_1$, shunted by a respective direction valve or one-way valve $E_2$ or $F_2$ to the ports $G_3$ and $G_4$ of the hydraulic motor G. A hydraulic accummulator I is also connected to the port $G_4$ while a hydraulic pressure relay H is connected to the accummulator to drain fluid pressure therefrom upon an increase in pressure above a predetermined limit.

A rotating ball-feed device J driven by a variable-speed rotator with a large control range and represented at L circulates the balls between the disks 4 and 7. A pump 8 forms part of a cooling-liquid supply system for recirculating a liquid coolant between the disks during the machining of the balls. The magazine J and the cooling unit M can be of conventional design.

In operation, the motor 1, via the gear chain previously described, drives the rotatable disk 4 while bearing balls are introduced between the disks 4 and 7 from the supply device J. When the distributor D is shifted to the right from its neutral position shown, hydraulic fluid passes via the throttle/valve assembly F to the cylinder $G_2$, tending to draw the disk 4 away from the disk 7, the hydraulic return being via the throttle/check valve assembly E. In the other operative position of the valve D, hydraulic fluid is fed to the accummulator I and to the cylinder $G_2$ at the left-hand end of the piston $G_1$ and forces the disk 4 to the right with a pressure corresponding to that in the accummulator I.

We claim:

1. An apparatus for machining bearing balls, comprising:

a fixed machining disk;

a rotatable machining disk spacedly juxtaposed with said fixed machining disk and adapted to machine bearing balls between said disks;

a ring gear connected to said rotatable disk;

a pinion meshing with said ring gear;

a telescoping-shaft coupling connected to said pinion for rotating same, said pinion and said ring gear being axially connected to said rotatable disk for movement therewith;

a gearbox having an output shaft connected to said telescoping-shaft coupling and an input shaft;

an electric motor having a motor shaft; and an elastic coupling connecting said motor shaft to the input shaft of said gearbox whereby said motor rotates said rotatable disk.

2. The apparatus defined in claim 1, further comprising:

a hydraulic motor having a piston connected to said rotatable disk for axially displacing same and a cylinder receiving said piston;

an electromotor-driven pump;

a distributing valve connected to said pump;

at least one adjustable-throttle and check valve assembly connected between said distributor and said cylinder;

a hydraulic accummulator connected to said cylinder; and a pressure relay connected to said hydraulic accummulator for limiting the pressure buildup therein, said distributor selectively pressurizing said cylinder to press said rotatable disk toward said fixed disk.

* * * * *